US006012259A

United States Patent [19]

Hallsten

[11] Patent Number: 6,012,259

[45] Date of Patent: Jan. 11, 2000

[54] TANK COVER STRUCTURE

[75] Inventor: Jeffrey A. Hallsten, Sacramento, Calif.

[73] Assignee: Hallsten Corporation, North Highlands, Calif.

[21] Appl. No.: 08/887,677

[22] Filed: Jul. 30, 1997

Related U.S. Application Data

[63] Continuation-in-part of application No. 08/835,290, Apr. 7, 1997, Pat. No. 5,911,662, which is a continuation of application No. 08/270,010, Jul. 1, 1994, Pat. No. 5,617,677, which is a continuation-in-part of application No. 07/932,491, Aug. 20, 1992, Pat. No. 5,325,646.

[51] Int. Cl.[7] ..... E04B 1/32

[52] U.S. Cl. ..... 52/246; 52/3; 52/5; 52/282.1; 52/650.3; 52/762

[58] Field of Search ..... 52/3, 5, 282.1, 52/167.9, 650.3, 762, 246

[56] References Cited

U.S. PATENT DOCUMENTS 5,325,646 7/1994 Hallsten et al. .
5,617,677 4/1997 Hallsten .
5,758,467 6/1998 Snear et al. ..... 52/650.3 X

*Primary Examiner*—Christopher T. Kent
*Attorney, Agent, or Firm*—Thomas M. Freiburger

[57] ABSTRACT

A cover for an elongated and relatively narrow tank or channel is formed from a series of panels arranged in parallel, edge-to-edge fashion, each panel spanning across the channel and resting on rims of the channel. Each panel is formed of a large plurality of side-by-side, preferably edge-connected deck slats having lengths extending in the longitudinal direction of the channel. At junctions between adjacent panels, structural transverse members have deck slat receiving channels for engaging with and supporting ends of the deck slats. In preferred embodiments the transverse structural members are generally L-shaped, with the L-shaped structural member of one channel nesting into the L-shaped structural channel of an adjacent panel, providing for removal of alternate panels by lifting. Deck slats include special handle slats for inclusion near the two transverse ends of the removable panels to enable lifting of the panels for access to the tank or channel. All of the connections between planks, structural members and other components preferably are made without welds, and sealing gaskets are provided for establishing a substantially gas tight seal.

30 Claims, 8 Drawing Sheets

TANK COVER STRUCTURE

This application is a continuation-in-part of application Ser. No. 08/835,290, filed Apr. 7, 1997, now U.S. Pat. No. 5,911,662 which was a continuation of application Ser. No. 08/270,010 filed Jul. 1, 1994, now U.S. Pat. No. 5,617,677, which was a continuation-in-part of application Ser. No. 07/932,491, filed Aug. 20, 1992, now U.S. Pat. No. 5,325,646.

BACKGROUND OF THE INVENTION

This invention is concerned with covers for tanks or open channels. In particular, the invention relates to a modular cover for a tank or channel of elongated shape, but width in the range of about eight to twenty feet, especially useful in sewage treatment tanks wherein a seal may be required and wherein access openings are required in the cover.

Increasingly there is a need for covers to enclose in-ground and above ground tanks used for storing waste materials including sewage, chemical sludge, petroleum products and other volatile and odorous materials. The materials generally are stored for later disposal or treatment in such tanks. Such a cover must be substantially gas tight for controlling odors in the vicinity of the tank site and for trapping potentially hazardous gases.

A tank cover is generally too large to be conveniently or cost effectively shipped in an assembled form from a manufacturer to the site of the tank. Because of this, tank covers for relatively large tanks are generally shipped as components and assembled at the site.

Prior art tank covers made of steel are heavy and expensive even to ship in component form. Further, such covers usually require welded connections and bolted connections in their assembly. As such, skilled personnel may be necessary to carry out the assembly, and the assembly process may be lengthy and costly. Some prior tank covers have been formed of sheet metal panels assembled at the site.

Tank covers for specific purposes are disclosed in U.S. Pat. No. 5,325,646 and U.S. Pat. No. 5,617,677. The latter discloses, in one embodiment, a cover for an elongated and narrow tank or channel. That cover is made up of a series of panels connected end-to-end, with deck planks of the panels extending transversely; thus, each plank spans essentially across the entire channel, avoiding the need for structural spanning members (other than the deck planks themselves) to extend across the channel.

Although utilizing deck planks or slats similar to those in the above-referenced copending application, the present invention uses the planks in a different orientation, for elongated tanks or channels having a width generally in the range of about 8 to 20 feet, and with special structural cross members which provide for efficient prefabrication and transport of individual panels, minimal construction time at the site, and the ability easily to remove some of the panels when needed for access to the tank.

The disclosures of the above-referenced copending application and issued patents are incorporated herein by reference.

SUMMARY OF THE INVENTION

In accordance with the present invention, a modular cover for elongated but relatively narrow channels, e.g., in the range of about 8 to 20 feet wide, is formed of metal extrusions, preferably aluminum extrusions. Instead of deck planks or slats spanning across the channel, as was the case in U.S. Pat. No. 5,617,677, which was generally directed to narrower channels, the deck slats of the invention extend in the longitudinal direction, framed between structural transverse channel spanning members.

In a preferred embodiment each panel is made up of a series of side-by-side planks throughout the width of the channel, each panel having its own structural members including channel-shaped recesses for gripping the ends of the planks and framing the panel.

An important feature of a preferred embodiment is that alternative panels (at least in some locations) are removable simply by lifting them out of the cover assembly. For this purpose, each removable panel rests on extending flanges of the two adjacent panels, forward and aft of the removable panel. In one specific embodiment, the extending flanges are formed by L-shaped transverse structural framing members, the depth of these framing members being designed for the particular width of the channel and the extending flange being at the bottom of the structural member. The removable panel in this preferred embodiment has a similar L-shaped cross section, with the flanges of the L-shaped structural members being oriented so as to permit every other panel to be lifted and removed. In other words, the two adjacent, non-removable panels each have flanges oriented toward the removable panel space providing a ledge for receiving the removable panel.

In another embodiment the fixed, non-removable panels can have transverse structural beams sufficiently strong to support the adjacent removable panels, which do not have their own spanning beams.

Thus, each structural channel spanning member may comprise a relatively tall, generally L-shaped extrusion having at its upper end a deck slat-receiving slot or channel arranged to receive the ends of all deck slats in the panel.

For situations requiring a substantially gas-tight seal, the transverse structural members of each removable panel have an elastomeric or otherwise flexible seal for engaging against the adjacent structural member. This may be on an additional flange at the top of the L-shaped member, extending toward and over the adjacent panel's structural member and having a slidingly fitted gasket seal member within a recess of the metal extrusion. In addition, the deck planks or slats preferably are sealed along lines where they are engaged together. In a preferred embodiment, the deck slats are interlocked at their sides, which may be in a manner disclosed in U.S. Pat. No. 5,617,677, with a hook type, rotated-together interengagement at a bottom edge of each plank and a tongue and groove connection at the top of the planks. This adds structural strength to the plank-to-plank connections, providing flexure strength in the width direction of the planks and panels and of the overall cover.

Preferably there are included in the removable panels a pair of special planks which form handles to facilitate removal. These special planks, of the same size and interchangeable with the normal deck planks or slats, may be included near the sides of the panel, that is, adjacent to the two tank rims which the panel spans across. Thus, the handle planks can be positioned wherever needed on prefabrication of the panels.

All panels for substantially gas tight service include a gasket seal where an edge extrusion of the panel rests on the concrete or steel rim at sides of the tank. The edge extrusion member preferably is interfitted with the adjacent plank or slat in the same way that adjacent planks are interlocked.

At long ends of the tank, the panels adjacent to those ends may have a different structural framing extrusion. The extrusion has the usual slat-receiving slot or channel, oriented with its open side toward the panel to receive the slats, but instead of the deep structure of the spanning transverse members, this member has a flat horizontal extension as in the edge extrusion, for example, about 5" or 6" long, to rest on the adjacent concrete or metal rim of the tank. The horizontal section has extruded T-shaped slots at its lower side to receive, in sliding assembly, one or more elastomeric or rubbery seals which become somewhat compressed or displaced when the panels are installed.

The extruded panel cover assembly of the invention is intended to provide an efficient structure useful in an intermediate span range, which may be about 8 to 20 feet wide, or, more generally, about 5 to 30 feet wide, for covering a long and narrow channel or tank. In general, under 8 feet in width, the assembly shown in the above-referenced U.S. Pat. No. 5,617,677 can be used, with each plank extending across the span; and in general, beyond 20 feet of span width prefabricated panels can usually be more economically assembled and supported by larger spanning beams, as required for weight and load, as also disclosed in the above-referenced copending application and U.S. Pat. No. 5,617,677.

Since the modular design of the invention is intended to provide access to the tank or channel, via alternately positioned prefabricated panels, the weight of the removable panels themselves is important. Generally it is desirable to limit the weight of the removable panels to about 150 lb., so that the panel can conveniently be removed.

The weight limit, of course, will have an influence on how wide the panels can be (i.e., how long the deck planks can be). As one example, for a 20 foot wide tank or channel, a 30 inch plank length (panel width), for plank cross sections generally as shown herein, will produce a panel of about 150 lb. Such relatively short deck planks can be relatively light in cross section. On the other hand, if a channel is considerably narrower than 20 feet, the planks will be longer to approximately reach the weight limit, and such planks will have to be heavier in cross section because of the greater span for the planks. The fact that the plank edges interlock and support tension between them at their bottom sides reduces the structural requirements of each plank in order to meet design loads.

The non-removable panels, alternating with the removable panels, can be wider and heavier if desired; however, it is generally preferred that consistency be maintained in the size of planks and structural spanning members, and thus it is preferable to maintain the same width for substantially all panels. Not only the plank cross section is affected by panel width, but also the size of the transverse, preferably L-shaped spanning members. The heavier the panel, the deeper must be the transverse spanning member. In addition, of course, the width of the channel can dictate the size of the L-shaped transverse spanning members, since much lighter members are needed for shorter width spans, although this is partially offset by widening of the panels and greater spacing of the spanning members which increases the load on each spanning member.

As a system of components for assembly into tank covers, the transverse spanning members can be kept consistent regardless of channel width if desired. Thus, as these L-shaped spanning beams go shorter because of less channel width, the panels are made wider, both because the 150 lb. limit is met by a wider panel and because the transverse beams are able to carry more weight when they have a shorter span.

It is therefore among the objects of the invention to simplify and make more efficient the covering of an elongated and relatively narrow tank or channel, particularly where a substantially gas-tight seal is required and where occasional access need be provided into the tank. This is accomplished with a versatile system of extruded components providing for covering of a range of different panel widths, for prefabrication of panels at a plant and relatively simple assembly steps at the site and providing for easy and quick removal of panels when necessary. These and other objects, advantages and features of the invention will be apparent from the following description of preferred embodiments, considered along with the accompanying drawings.

DESCRIPTION OF THE PREFERRED EMBODIMENTS

Figure 1:
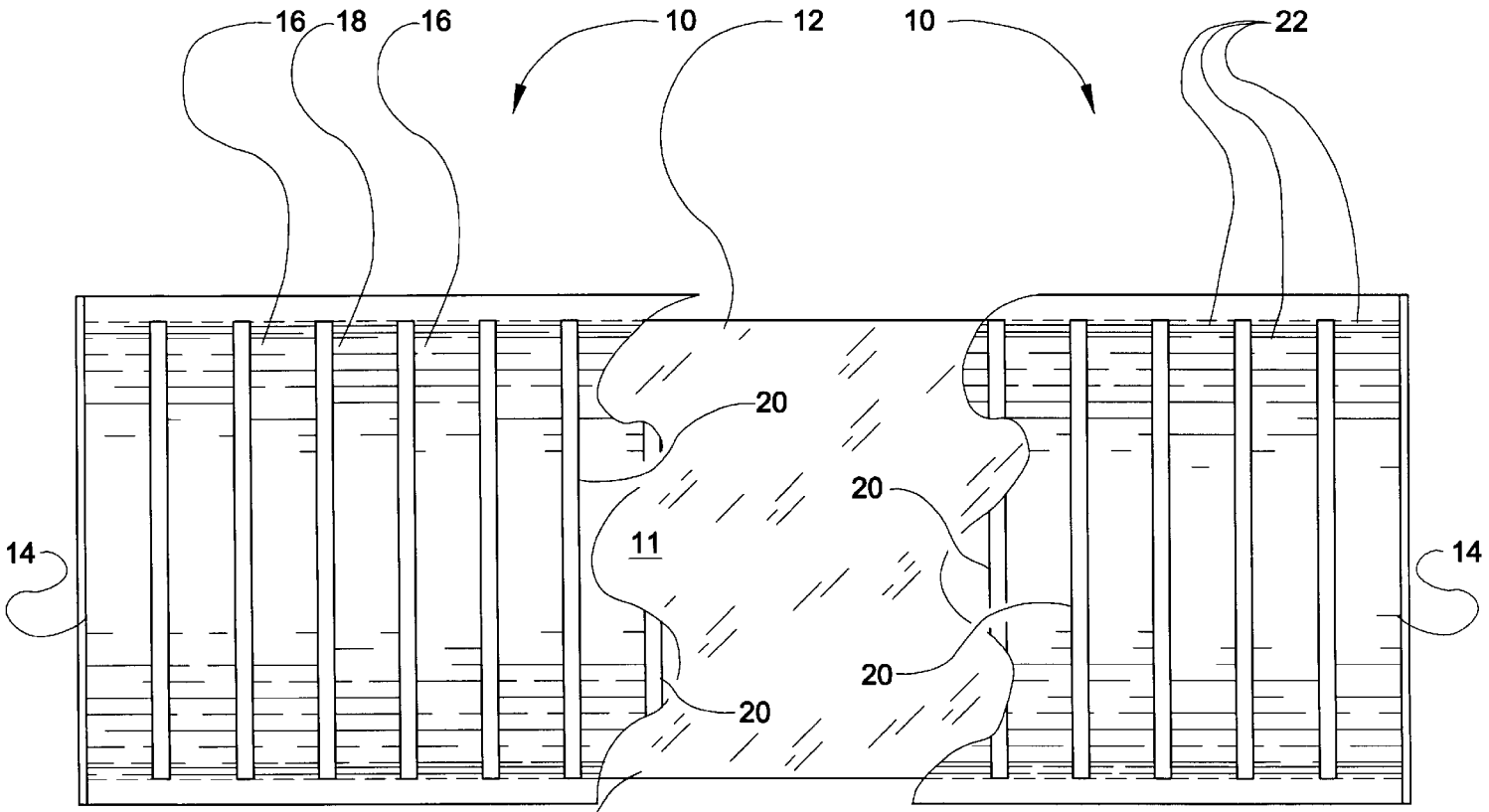
FIG. 1 is a somewhat schematic and fragmented plan view showing a tank or channel with a tank cover system according to the invention.

In FIG. 1 a tank or channel cover assembly is shown generally at 10, covering an elongated and relatively narrow tank 11, side rims of which are seen at 12 and end rims of which are seen at 14. As can be seen from FIG. 1, the tank 11 is long and relatively narrow, and the invention is intended to apply generally to tanks having a width between about 5 and 30 feet, and more preferably between about 8 and 20 feet, as explained above.

FIG. 1 shows a configuration in which the tank cover 10 has relatively short (narrow as viewed in FIG. 1) panels 16 and 18. As explained above, these can be the case where the width of the tank is relatively large within the intended range, so that narrower panels are needed in order to meet a weight limitation for convenient removal of some of the panels.

The tank cover assembly 10 includes transverse structural spanning members 20 as indicated, each of which spans across the panel and frames deck slats or planks 22 within the respective panel. The deck slats 22 are oriented in the longitudinal direction relative to the tank or channel. As an example only, the channel 11 shown in the drawing may have a width of about 20 feet, with the planks 22 and thus the panels being short, about 2½ to 3 feet.

Figure 2:
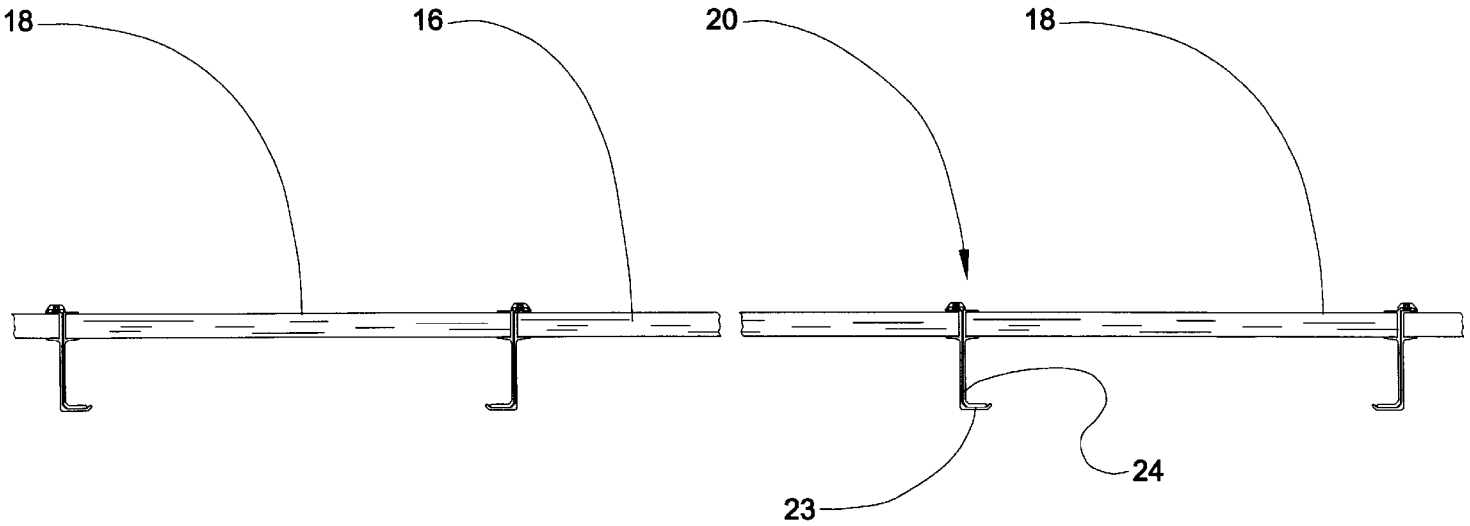
FIG. 2 is a cross sectional view, looking in the transverse direction through the cover structure, as seen along the line 2—2 in FIG. 1.
Figure 3:
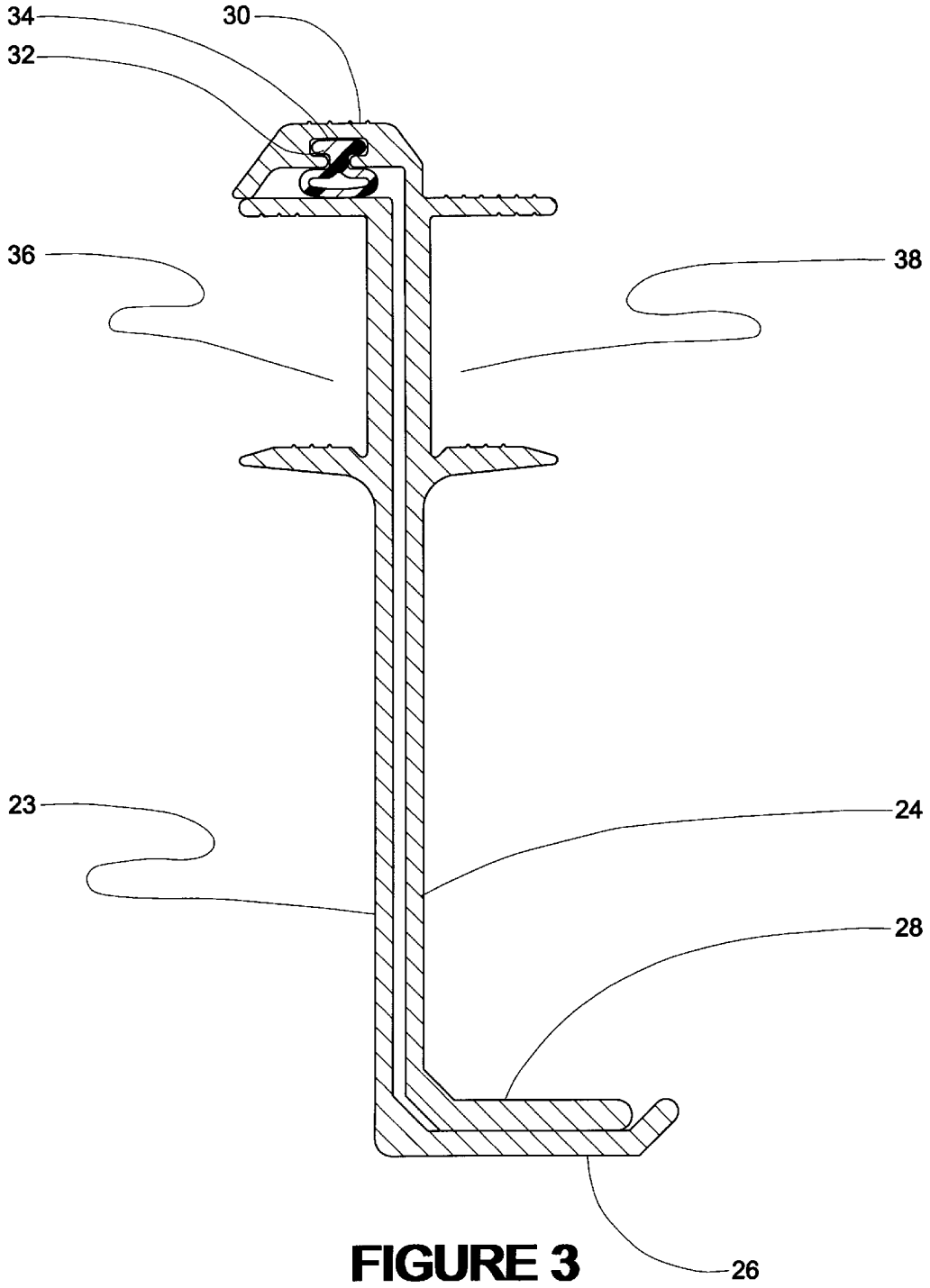
FIG. 3 is a detailed sectional view showing a pair of transverse structural beams or spanning members of the tank system, again looking transversely.

As can be seen in FIGS. 2 and 3, each transverse spanning beam 20 in this preferred embodiment is actually made up of a pair of transverse spanning beams 23 and 24 together. This arrangement, as explained above, is provided to allow alternate panels 18 to be easily removed. Thus, the transverse spanning beams 23 of panels 16 are oriented as shown, with support flanges 26 extending toward the removable panels base 18. This provides a supporting ledge which in part receives the weight of the adjacent, removable panel 18, which in a preferred embodiment has a similar, nested flange 28 resting on the flange 26 as shown. In addition, the transverse extrusions 24 of the removable panels may have an upper flange 30 extending in the opposite direction, i.e., toward the fixed panel space 16, to help support the weight of the removable panel and to hold a flexible sealing gasket 32 within a slot 34, so that the gasket is squeezed downwardly against the fixed-panel extruded beam 23 as shown in FIG. 3.

Each of the transverse spanning extrusions 23 and 24 has a deck slat-receiving slot or channel 36 or 38 as shown particularly in FIG. 3. These slots or channels are shown receiving the deck slats 22 in FIG. 2.

Thus, the spanning extrusions 23 and 24 are nested together and thus doubled to make the total structural spanning strength required at the junction of the panels. Each panel preferably is designed to support its share of the load, so that with alternate panels 18 removed, the remaining panels 16 will support their own strength and the design load.

Figure 3A:
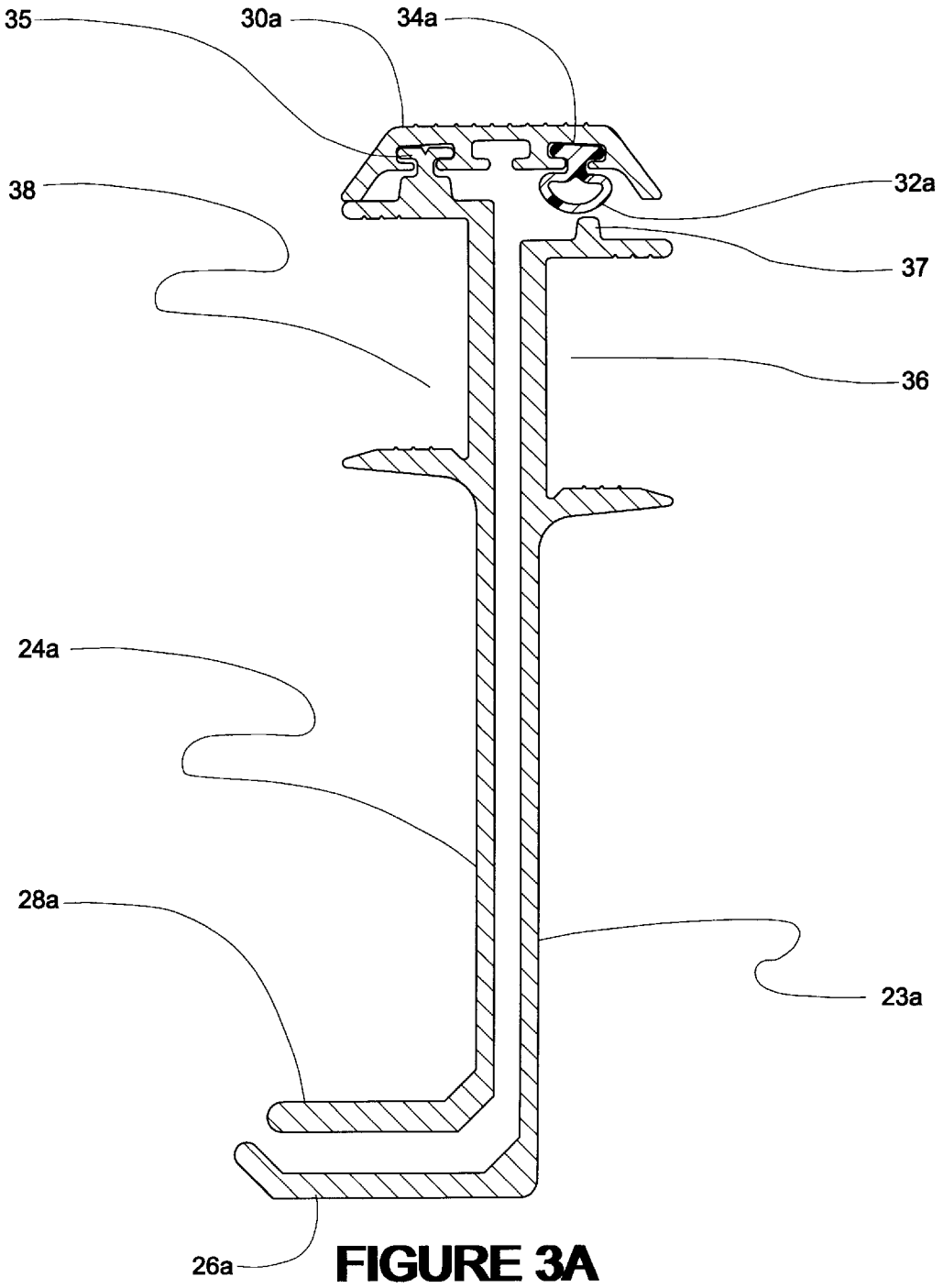
FIG. 3A is a sectional view similar to FIG. 3 but showing a modified embodiment.

FIG. 3A shows a modified pair of nesting transverse spanning beams 23*a* and 24*a*. In this embodiment the lower flanges 26*a* and 28*a* nest together as in FIG. 3, but with somewhat different extruded shapes. Also, at the top of the beam 24*a* the upper flange 30 of FIG. 3 is replaced with a separate cap member 30*a*which assembles to an interlock 35 at the top of the beam 24*a*, preferably with a sprayed-on seal providing a substantially gas tight barrier. An elastomeric seal 32*a* (which may be the material Santoprene) assembles into a slot 34*a* to be in position to be engaged by the top of the beam 23*a* to make a seal, and a flange 37 may be included on the beam 23*a* to engage with the seal 32*a*.

The deck slats of each panel are secured to the transverse spanning extrusion throughout its length, and at edges of the tank the panels rest on the rim 12 of the tank via connections to the edge deck slats of each panel. Thus, each transverse beam 23 and 24 is supported on the rim 12 of the tank.

Figure 4:
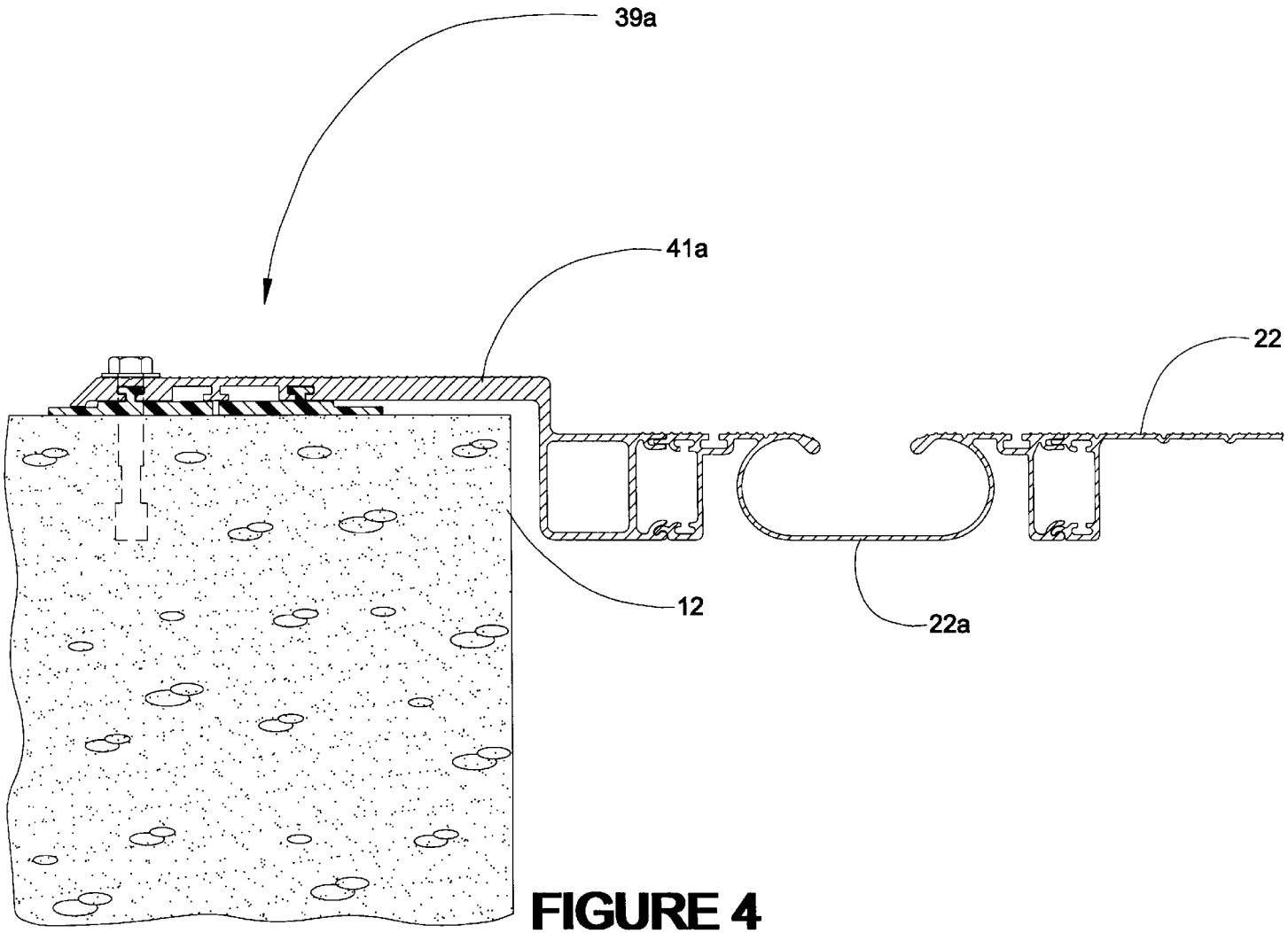
FIG. 4 is a partial sectional view showing a portion of the tank assembly near one rim or edge of the tank.
Figure 5:
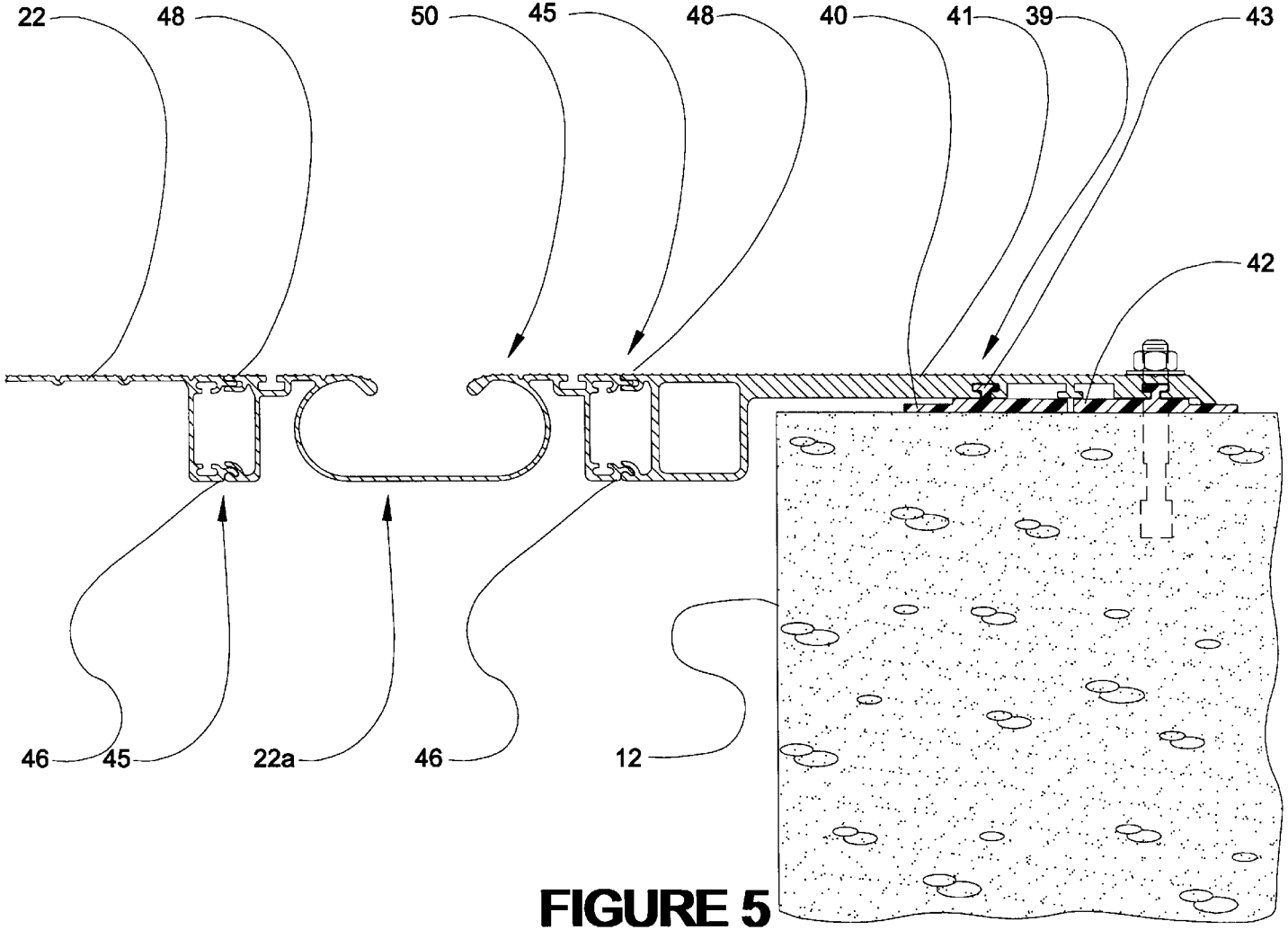
FIG. 5 is a view similar to FIG. 4, but at an opposite side of the tank or channel and showing a different rim or edge situation.
Figure 5A:
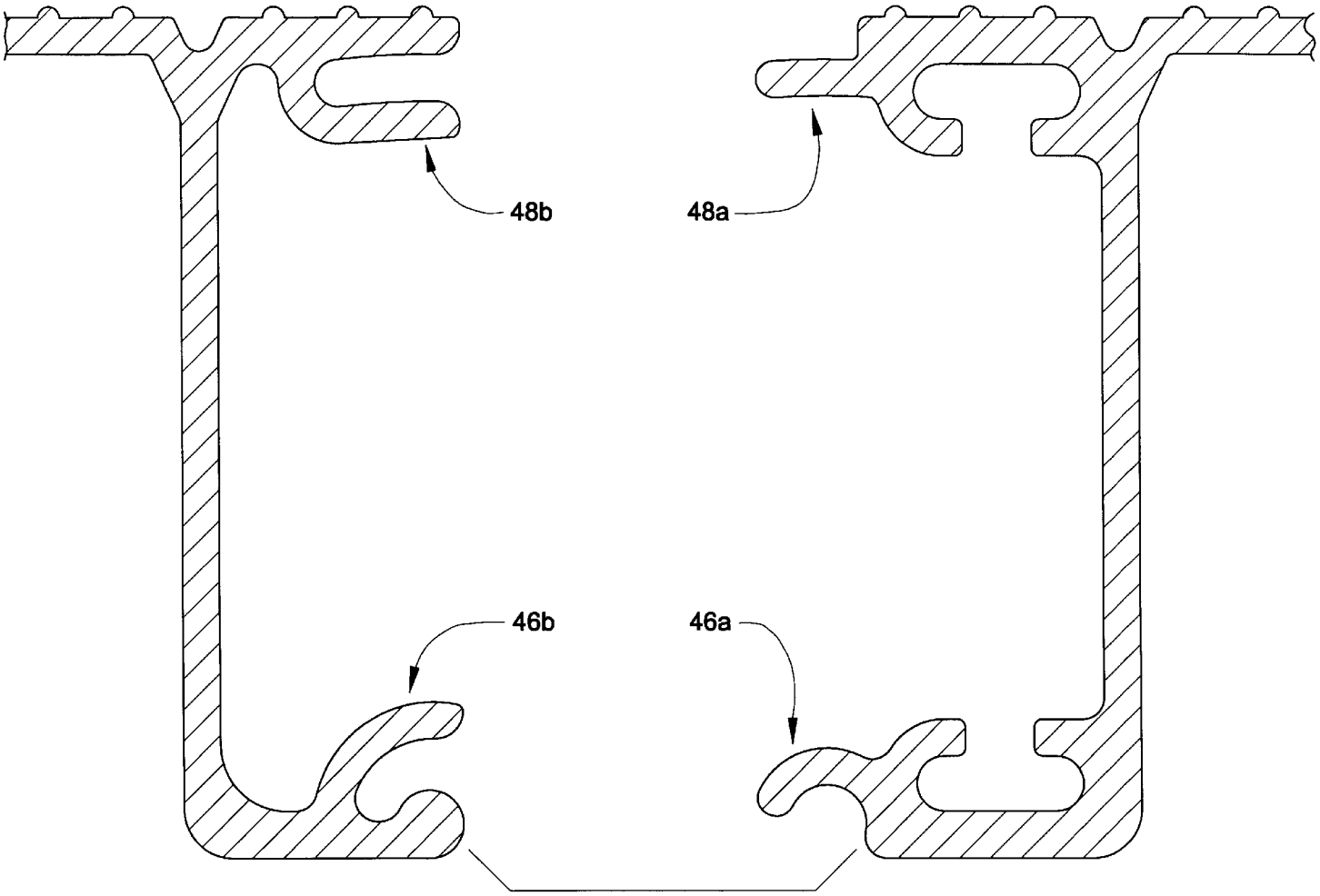
FIG. 5A is an enlarged, exploded detail showing plank edge connections.

FIGS. 4 and 5 show one preferred configuration by which the panels are supported at the rim of the tank. FIGS. 4 and 5 are cross sectional views looking in the longitudinal direction of the tank, thus showing the rims 12 at left and right. These views therefore show the deck slats 22 in cross section, and their connection with an edge extrusion 39 which is adapted to connect with an adjacent deck slat and to rest on the surface of the rim 12 as shown. The edge or rim extrusion 39 has a generally flat, horizontal plate like extension 41, which may be 5 or 6 inches wide, for example, to rest on the tank rim. As indicated, this horizontal portion may have T-shaped slots 43 formed in the bottom of the extrusion, to receive one or more flexible sealing pads 40 and 42, acting as gaskets to be squeezed down against the rim 12 under the weight of the adjacent panel and its load. At the inner end of the edge or rim extrusion 39 is an interlock connection 45, imitating the same interlock structure as on the edges of the slats themselves, i.e., a hooked, rotation connection 46 at the lower side and a tongue and groove connection 48 at the upper side. This interlock structure is shown in detail in FIG. 32 of U.S. Pat. No. 5,617,677, incorporated herein by reference, and is shown enlarged in FIG. 5A, where the components are shown separated with the bottom hook components shown as 46*a* and 46*b* and the top connectors shown as 48*a* and 48*b*. Because of the hook-like connection 46 between bottom edges of all adjacent slats, the slats are locked together against pulling apart as well as against relative up or down movement. The tongue and groove connection 48 at the upper sides of these slats preferably is a tight fit and provides a substantially gas-tight seal at that juncture, which can be enhanced by spraying of an appropriate coating on either the top of the assembled joint or on the tongue and groove components before assembly.

FIGS. 4 and 5 also show a special deck slat 22*a*, providing a handle 50 for removal of the alternate panels 18. As explained above, these slats 22*a* preferably are used near the rims 12 of the tank as shown in FIGS. 4 and 5, and in a preferred embodiment they are interchangeable with the normal deck slats 22, being of the same dimensions.

FIG. 4 shows a slightly modified edge extrusion 39*a* for use as a rim 12 which is higher than the rim shown in FIG. 5. Thus, the member 39*a* has an angle at 41*a*.

Figure 6:
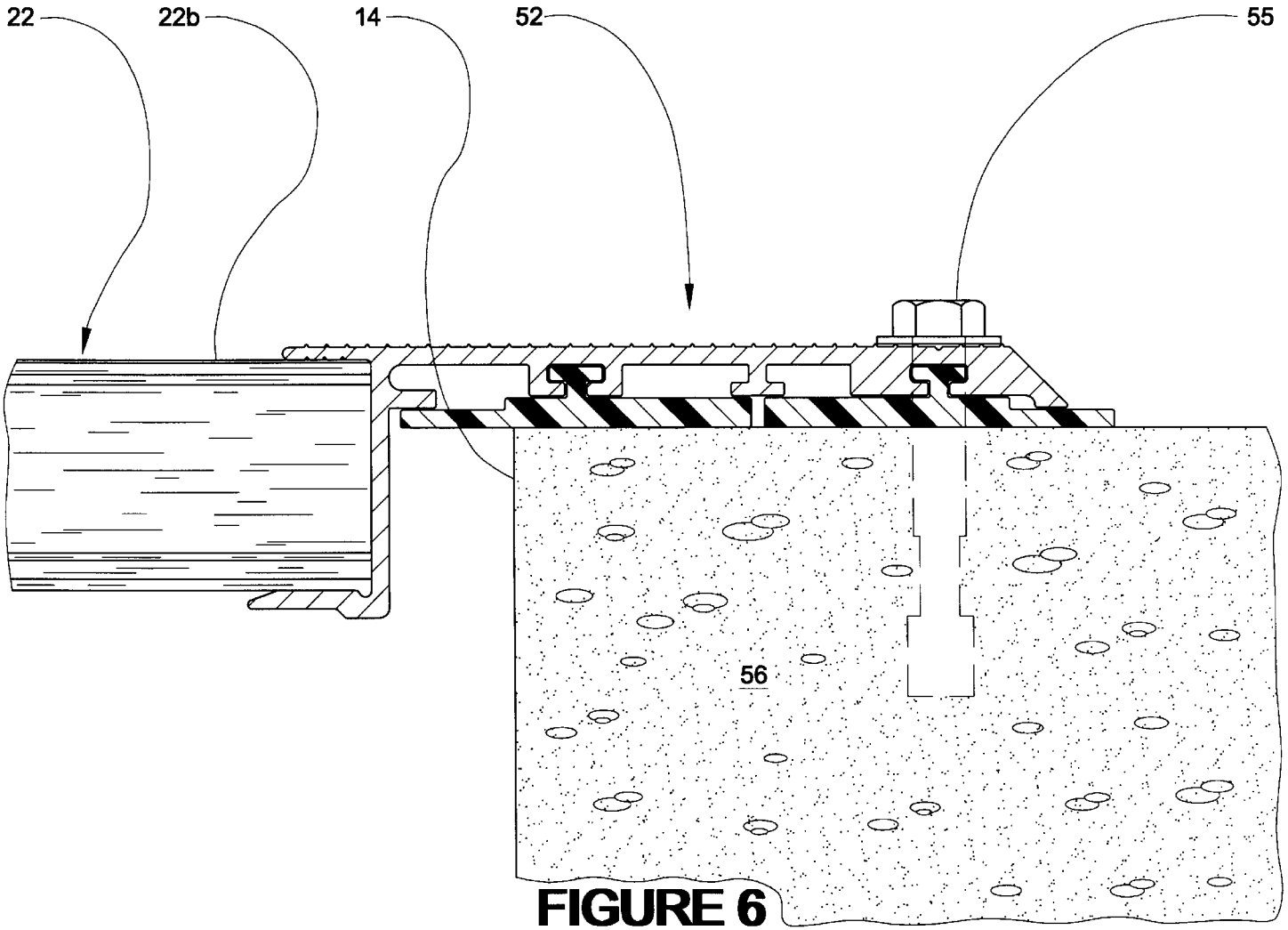
FIG. 6 is a sectional view showing a portion of the cover construction at a long end of an the tank or channel.

FIG. 6 shows an end extrusion 52 and its manner of assembly into the adjacent panel as well as to the long end rim 14 of the tank or channel. The extrusion 52 may be similar to the side edge extrusion 34 insofar as its engagement with the concrete or steel rim 14; however, it is different on its panel facing side, since it must receive the ends 22*b* of the deck slats 22 as shown in FIG. 6. The same types of seals or gaskets 40 and 42 as in the edge extrusions 34 may be included. A bolt 55 is shown, of the type which anchors in a hole bored in existing, cured concrete 56. The end extrusions 52 are thus bolted down at intervals as needed. The edge extrusions 34 can be secured down similarly, including both removable and nonremovable panels 18 and 16, respectively.

The term "nonremovable" and "fixed" as applied to the panels 16 or 16*a* is, of course, a relative term. These panels are assembled into place using bolts such as the bolt 55 shown in FIG. 6, and can be removed after removal of the "removable" panels 18, if desired.

Although the embodiment described above has a preferred spanning beam configuration in which each panel, removable and nonremovable, has its own spanning support, provided by the nested L-shaped beams shown in FIGS. 2 and 3, the invention also contemplates an alternative arrangement in which the fixed panels 16 have transverse spanning structural members providing adequate support for the fixed panel 16 as well as for the adjacent removable panels 18, which themselves would not have adequate support. In such an embodiment the transverse structural beams 21 of the fixed panels 16 are made deeper, and their tail flanges 26 can be made heavier or in a different configuration, such as a T shaped flange at the bottom of the beam (not shown). The adjacent panels 18 would then have slot or channel-shaped edge retaining means such as 38 as shown in FIG. 3, to frame the edges of the deck slats for the removable panel, but preferably no further structure below the plank receiving channel. This channel can then rely on the engagement by a top flange 30 such as shown in FIG. 3 down against the top of the neighboring transverse structural beam 21 of the fixed panel. Such a construction will make the fixed panel 16 somewhat heavier for transport and the removable panels somewhat lighter, but may be advantageous in some circumstances, and will make the panels slightly easier to handle in removal since they will have a shallower cross section.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. A cover for an open-topped structure such as a tank or channel having a cover-supporting rim or edge, the structure having a relatively narrow width, comprising:

a series of panels arranged in parallel, edge-to-edge fashion to span across the open-topped structure, including fixed panels and removable access panels, each panel having a width for spanning transversely from one edge to an opposite edge of the open-stopped structure, each panel being formed of a plurality of side-by-side edge-connected elongated deck slats, each slat comprising a metal extrusion and having a length arranged to extend in the longitudinal direction of the tank or channel, the deck slats being unsupported except at their ends, and transverse channel means at ends of the deck slats for engaging the deck slats and holding the panel together, and extruded structural beam means connected to each channel means at a junction of two adjacent panels, for providing structural channel-spanning support at the adjacent ends of deck slats of the two adjacent panels while permitting at least some panels located between two adjacent fixed panels to be removed by lifting from the open-topped structure, serving as said removable access panels.

2. The cover of claim 1, wherein the extruded structural beam means comprises an extruded beam which includes the channel means of a fixed panel as an integral extrusion, each removable access panel having support means for supporting the transverse channel means of the removable access panel on the extruded beam of the adjacent fixed panel to connect the removable panel to the extruded structural beam means.

3. The cover of claim 2, wherein the transverse channel means of the removable panel includes an upper flange extending over the extruded beam of the adjacent fixed panel, positioned to rest on the top of the extruded beam of the fixed panel.

4. The cover of claim 3, further including a flexible gasket seal between said upper flange and the top of the extruded beam.

5. The cover of claim 4, wherein the removable panel further includes a lower extension connected to the transverse channel means of the removable panel, with a lower flange at the bottom of the extension oriented inwardly relative to the removable panel, said transverse channel means, upper flange, extension and lower flange of the removable panel comprising an extruded beam of the removable panel which rests on the extruded beam of the fixed panel.

6. The cover of claim 1, wherein the removable panel further includes a lower extension connected to the transverse channel means of the removable panel, with a lower flange at the bottom of the extension oriented inwardly relative to the removable panel, said transverse channel means, extension and lower flange of the removable panel comprising an extruded beam of the removable panel which rests on the extruded beam of the fixed panel.

7. The cover of claim 1, wherein the removable access panels include special deck slats near ends of the removable panel, the special deck slats having handles for gripping and lifting the removable access panels and the special slats being interchangeable with other deck slats of the removable panel.

8. The cover of claim 1, wherein alternate panels comprise said removable access panels, substantially throughout the length of the cover.

9. The cover of claim 1, wherein the removable access panels have a weight not more than about 150 lb.

10. The cover of claim 1, wherein each panel includes, at each of its two ends extending to opposed rims of the tank or channel, a rim extrusion secured to an outermost deck slat of the panel and having a generally horizontal plate like extension for resting on the rim of the tank or channel.

11. The cover of claim 10, further including a gasket seal secured to the underside of the plate like extension, for sealing between the plate like extension and the rim of the tank.

12. The cover of claim 11, wherein the panels include two opposed end panels, each positioned to be adjacent to a long end of the tank or channel, and including an end extrusion secured to each end panel, the end extrusion having slat-receiving channel means for engaging ends of slats of the panel and gripping the slats, and having a plate like extension.

13. A cover for an open-topped structure such as a tank or channel having a cover-supporting rim or edge, the structure having a relatively narrow width, comprising:

a series of panels arranged in parallel, edge-to-edge fashion to span across an open-topped structure, including fixed panels and removable access panels, each panel having a width for spanning transversely from one edge to an opposite edge of the open-topped structure, each panel being formed of a plurality of side-by-side edge-connected elongated deck slats, each slat comprising a metal extrusion, and including means at ends of the deck slats for engaging the ends of the deck slats, and extruded structural beam means at a junction of two adjacent panels, for spanning across the width of the tank or channel and having two opposed ends each positioned to be supported at said rim or edge, for providing structural tank-spanning support for the two adjacent panels while permitting at least some panels located between two fixed panels to be removed by lifting from the open-topped structure without movement of the fixed panels, serving as said removable access panels.

14. The cover of claim 13, wherein the extruded structural beam means comprises a first extruded beam secured to and forming a part of a fixed panel, and a second extruded beam secured to an adjacent removable access panel, the first extruded beam having a lateral flange extending generally horizontally in the direction of the removable access panel, in position to support the second extruded beam and thus to support the removable access panel.

15. The cover of claim 14, wherein the second extruded beam of the removable panel includes an upper flange extending over the adjacent fixed panel, positioned to rest on the top of the fixed panel.

16. The cover of claim 15, further including a flexible gasket seal between said upper flange and the top of the adjacent fixed panel.

17. The cover of claim 14, further including nesting means cooperative between the first and second extruded beams, for nesting the second extruded beam against the first extruded beam.

18. The cover of claim 14, wherein the second extruded beam includes a second lateral flange extending generally horizontally in a direction inward of the removable panel, positioned to rest on the lateral flange of the first extruded beam of the fixed panel.

19. The cover of claim 13, wherein alternate panels comprise said removable access panels, substantially throughout the length of the cover.

20. The cover of claim 13, wherein each panel includes, at each of its two ends for extending to and support on opposed rims of the tank or channel, a rim extrusion extending from the panel and having a generally horizontal plate-like extension for resting on the rim of the tank or channel.

21. The cover of claim 20, further including a gasket seal secured to the underside of the plate-like extension, for sealing between the plate-like extension and the rim of the tank and for isolating the rim extrusion from the rim of the tank.

22. The cover of claim 21, wherein the plate-like extension includes at its underside an elongated slot formed integrally in the rim extrusion and positioned to extend parallel to the channel rim on which the plate-like extension is arranged to rest, with the gasket seal having an upper portion assembled into and retained by the elongated slot.

23. The cover of claim 13, wherein the panels include two opposed end panels, each positioned to be adjacent to a long end of the tank or channel, and including an end extrusion secured to each end panel, the end extrusion having a generally horizontal plate-like extension positioned to rest on the rim of the tank or channel.

24. The cover of claim 23, further including a gasket seal secured to the underside of the plate-like extension, for sealing between the plate like extension and the rim of the tank.

25. The cover of claim 24, wherein the plate-like extension includes at its underside an elongated slot formed integrally in the rim extrusion and positioned to extend parallel to the channel rim on which the plate-like extension is arranged to rest, with the gasket seal having an upper portion assembled into and retained by the elongated slot.

26. The cover of claim 13, wherein said means at ends of the deck slats is integral with the extruded structural beam means, which extends perpendicular to the deck slats.

27. The cover of claim 14, wherein the deck slats extend perpendicular to the extruded beams, and wherein said means at ends of the deck slats comprises a slat-receiving slot formed in each of the first extruded beam and the second extruded beam, with ends of deck slats of respective panels fitted into the slots.

28. A cover for an open-topped structure such as a tank having a cover-supporting rim or edge, the structure having a relatively narrow width, comprising:

a series of panels arranged in parallel, edge-to-edge fashion across the open-topped structure, including fixed panels and removable access panels, each panel having a width for spanning transversely from one edge to an opposite edge of the open topped structure, each panel being formed of a plurality of side-by-side edge-connected elongated deck slats, each slat comprising a metal extrusion, and means retaining the panel together as a unit, and a transverse spanning beam at the edge of each panel where a fixed panel joins an adjacent removable panel such that at a junction of two adjacent panels, a first transverse spanning beam forms a part of the fixed panel and a second transverse spanning beam forms a part of the removable panel, and the transverse spanning beams being so configured that said second transverse spanning beams of the removable panel rest on said first transverse spanning beams of adjacent fixed panels.

29. A cover in combination with an open-topped tank structure having a cover-supporting rim or edge, the tank structure having a relatively narrow width, comprising:

a series of panels arranged in parallel, edge-to-edge fashion across the open-topped tank structure, including fixed panels and removable access panels, each panel having a width spanning transversely from one edge to an opposite edge of the open-topped tank structure, each panel being formed of a plurality of side-by-side edge-connected elongated deck slats, each slat comprising a metal extrusion, and means retaining the panel together as a unit, and a transverse spanning beam at the edge of each panel where a fixed panel joins an adjacent removable panel such that at a junction of two adjacent panels, a first transverse spanning beam forms a part of the fixed panel and a second transverse spanning beam forms a part of the removable panel, and the transverse spanning beams being so configured that said second transverse spanning beams of the removable panel rest on said first transverse spanning beams of adjacent fixed panels.

30. A cover in combination with an open-topped structure such as a tank or channel having a cover-supporting rim or edge, the structure having a relatively narrow width, comprising:

a series of panels arranged in parallel, edge-to-edge fashion across the open-topped structure, including fixed panels and removable access panels, each panel having a width spanning transversely from one edge to an opposite edge of the open-topped structure, each panel being formed of a plurality of side-by-side edge-connected elongated deck slats, each comprising a metal extrusion and having a length extending in the longitudinal direction of the open-topped structure, the deck slats being unsupported except at their ends, and transverse channel means at ends of the deck slats for engaging the deck slats and holding the panel together, and extruded structural beam means connected to each channel means at a junction of two adjacent panels, for providing structural channel-spanning support at the adjacent ends of deck slats of the two adjacent panels while permitting at least some panels located between two adjacent fixed panels to be removed by lifting from the open-topped structure, serving as said removable access panels.

* * * * *